US008540531B2

(12) United States Patent
Harris

(10) Patent No.: US 8,540,531 B2
(45) Date of Patent: Sep. 24, 2013

(54) EMI CONNECTOR FERRULE AND ASSEMBLY COMBINATION THEREWITH

(75) Inventor: David A. Harris, Coatesville, PA (US)

(73) Assignee: Federal Mogul Powertrain, Inc., Southfield, MI (US)

( * ) Notice: Subject to any disclaimer, the term of this patent is extended or adjusted under 35 U.S.C. 154(b) by 154 days.

(21) Appl. No.: 13/160,613

(22) Filed: Jun. 15, 2011

(65) Prior Publication Data

US 2011/0312216 A1 Dec. 22, 2011

Related U.S. Application Data

(60) Provisional application No. 61/355,291, filed on Jun. 16, 2010.

(51) Int. Cl.
*H01R 13/40* (2006.01)

(52) U.S. Cl.
USPC ..... 439/587

(58) Field of Classification Search
None
See application file for complete search history.

(56) References Cited

U.S. PATENT DOCUMENTS

| | | | | |
|---|---|---|---|---|
| 3,238,494 | A | 3/1966 | Bentley | |
| 3,781,762 | A | 12/1973 | Quackenbush | |
| 3,830,957 | A | 8/1974 | Oberdiear | |
| 4,433,206 | A | 2/1984 | Lewis | |
| 4,799,900 | A | 1/1989 | Capp et al. | |
| 4,808,128 | A | 2/1989 | Werth | |
| 5,508,475 | A | 4/1996 | Profiri et al. | |
| 5,691,506 | A | 11/1997 | Miyazaki et al. | |
| 6,595,789 | B2 | 7/2003 | Oota et al. | |
| 7,101,223 | B2 | 9/2006 | Neumann et al. | |
| 7,331,820 | B2 * | 2/2008 | Burris et al. | 439/578 |
| 7,422,479 | B2 | 9/2008 | Chee et al. | |
| 8,303,338 | B2 * | 11/2012 | Chen | 439/583 |
| 2005/0014421 | A1 | 1/2005 | Sweetland | |
| 2006/0027536 | A1 * | 2/2006 | Kornrumpf | 219/50 |
| 2006/0134943 | A1 | 6/2006 | Sweetland | |
| 2008/0261452 | A1 | 10/2008 | Nagashima et al. | |
| 2009/0093159 | A1 | 4/2009 | Aoki et al. | |
| 2009/0260232 | A1 | 10/2009 | Aoki et al. | |

FOREIGN PATENT DOCUMENTS

| | | |
|---|---|---|
| DE | 102008023137 | 10/2009 |
| GB | 2396256 | 6/2004 |

* cited by examiner

*Primary Examiner* — Jean F Duverne
(74) *Attorney, Agent, or Firm* — Robert L. Stearns; Dickinson Wright, PLLC

(57) ABSTRACT

A ferrule configured to couple a textile sleeve to an electrical has a cylindrical wall with an inner surface providing a cavity sized for receipt of an elongate electrical member therethrough. The cylindrical wall extends between a first end configured for attachment within a cavity of the textile sleeve and a second end having a radially outwardly extending annular rim configured for attachment to the electrical connector. The cylindrical wall has at least one radially outwardly extending annular bead adjacent the first end with the annular bead providing a radially inwardly facing annular pocket. At least one seal member is disposed in the cavity for sealed abutment with the inner surface and the elongate electrical member.

18 Claims, 3 Drawing Sheets

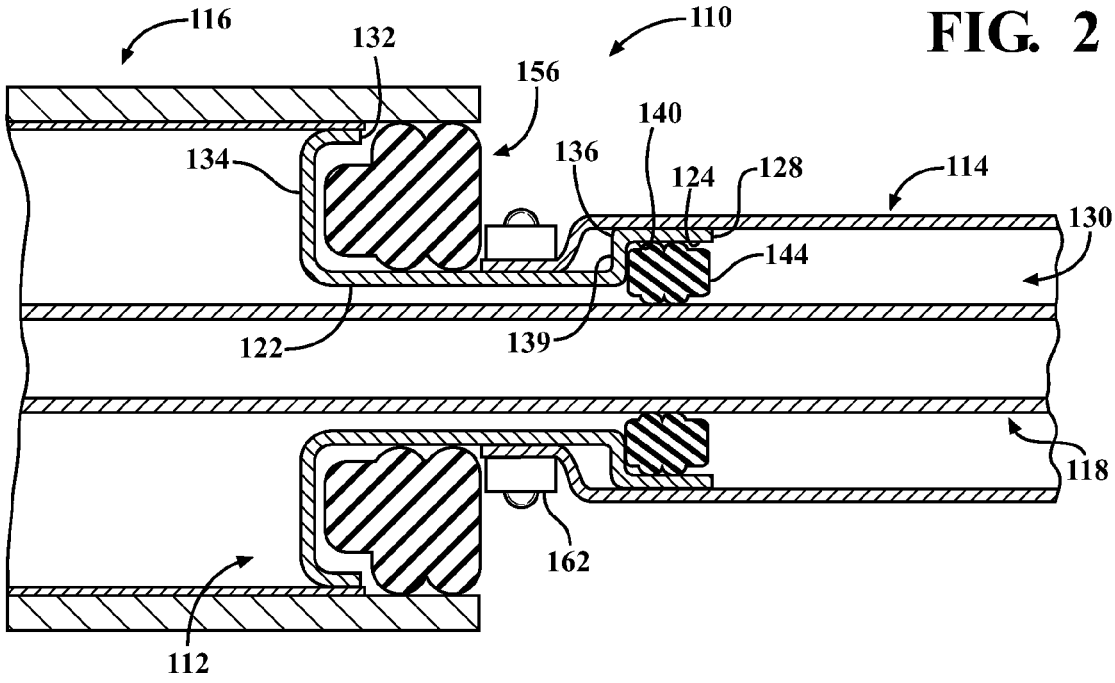
FIG. 2
FIG. 3
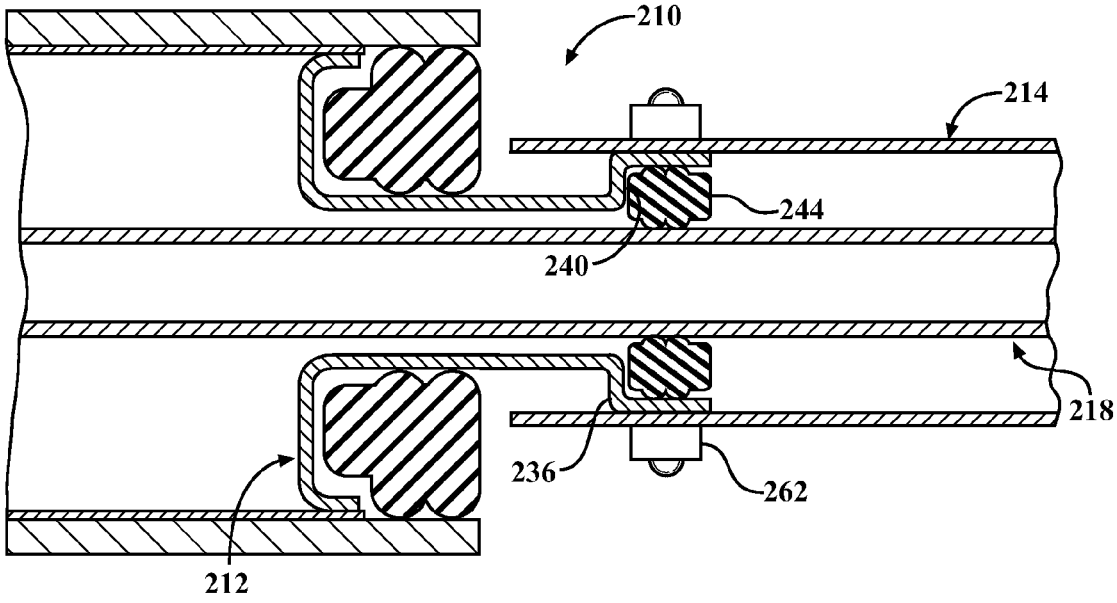

EMI CONNECTOR FERRULE AND ASSEMBLY COMBINATION THEREWITH

CROSS-REFERENCE TO RELATED APPLICATION

This application claims the benefit of U.S. Provisional Application Ser. No. 61/355,291, filed Jun. 16, 2010, which is incorporated herein by reference in its entirety.

BACKGROUND OF THE INVENTION

1. Technical Field

This invention relates generally to electrical connectors and, more particularly, to connector ferrules configured to couple and ground a protective sleeve to and electrical connector.

2. Related Art

It is known to protect elongate wires with metallic protective sleeves to provide a shield against electromagnetic interference (EMI). It is further known to ground the protective sleeve via a ferrule to an upstream metal electrical connector. Unfortunately, the connection between the sleeve and the ferrule is typically located within the electrical connector, and thus, the assembly process is complicated and the sleeve can not be removed from the wires during service without first having to remove the ferrule from the electrical connector. In addition, there remains a need to improve the resistance to the ingress of fluid, e.g. water, into the electrical components of the electrical assembly, such as between the connection location of the protective sleeve to the ferrule and between the connection location of the ferrule to the electrical connector. Further yet, there remains a need to provide a ferrule that can be adapted to a variety of protective sleeve configurations without having to have a separate ferrule or protective sleeve configuration for individual applications.

SUMMARY OF THE INVENTION

A ferrule and assembly therewith constructed in accordance with the invention provides an economical, easy to assemble/disassemble, watertight, and otherwise reliable connection between a protective textile sleeve and an electrical connector, while also providing a reliable ground path between the textile sleeve and the electrical connector.

A ferrule configured to couple a textile sleeve to an electrical connector in accordance with one aspect of the invention has a cylindrical wall with an inner surface providing a cavity sized for receipt of an elongate electrical member therethrough. The cylindrical wall extends between a first end configured for attachment within a cavity of the textile sleeve and a second end having a radially outwardly extending annular rim configured for attachment to the electrical connector. The cylindrical wall has at least one radially outwardly extending annular bead adjacent the first end with the annular bead providing a radially inwardly facing annular pocket. Further, at least one seal member is disposed in the cavity for sealed abutment with the inner surface and the elongate electrical member.

In accordance with another aspect of the invention, a ferrule in combination with an electrically conductive textile sleeve, an elongate electrical member received in the textile sleeve, and an electrically conductive electrical connector is provided. The ferrule has a cylindrical wall with an inner surface providing a cavity sized for receipt of the elongate electrical member therethrough. The cylindrical wall extends between one end configured for attachment within an inner cavity of the textile sleeve and another end having a radially outwardly extending annular rim configured for attachment to the electrical connector. The cylindrical wall has at least one radially outwardly extending annular bead adjacent the end configured for attachment within the inner cavity of the textile sleeve with the annular bead providing a radially inwardly facing annular pocket. Further, at least one seal member is disposed in the cavity for sealed abutment with the inner surface and the elongate electrical member.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

FIG. 2 illustrates a cross-sectional side view of a ferrule constructed in accordance with another aspect of the invention shown coupling a textile protective sleeve to an electrical connector housing;

FIG. 3 illustrates a cross-sectional side view of the ferrule of FIG. 2 shown coupling a textile protective sleeve to an electrical connector housing in accordance with another aspect of the invention.

DETAILED DESCRIPTION OF PRESENTLY PREFERRED EMBODIMENTS

Figure 1:
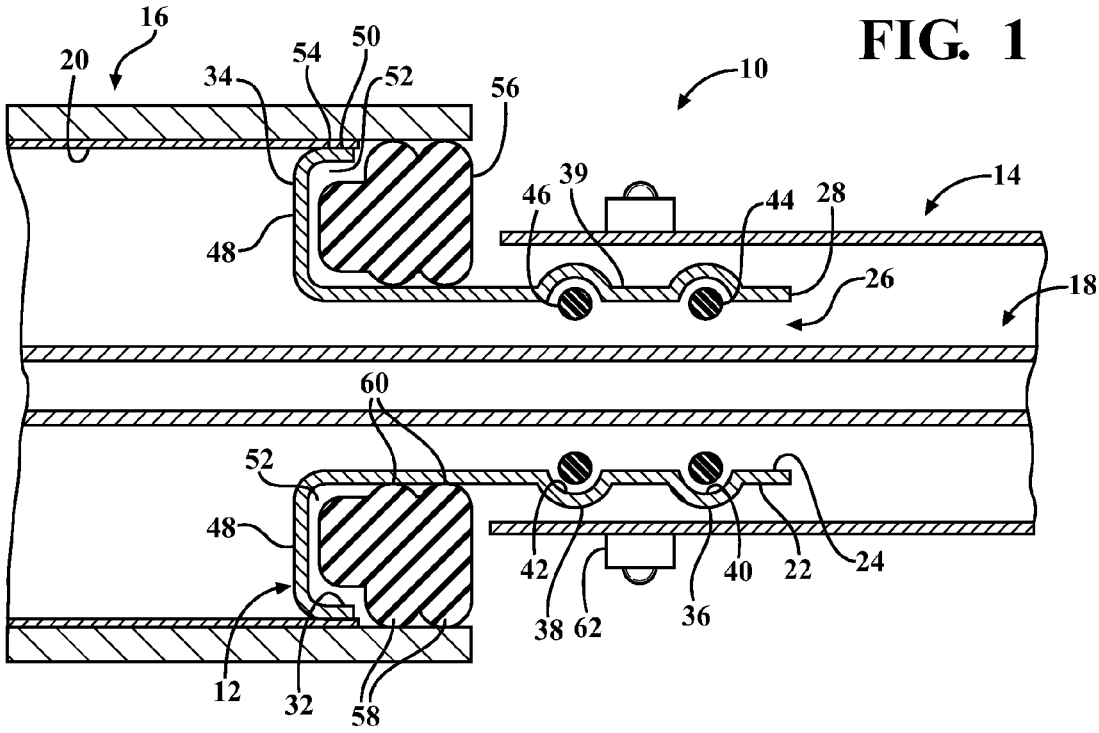
FIG. 1 illustrates a cross-sectional side view of a ferrule constructed in accordance with one aspect of the invention shown received within a textile protective sleeve and an electrical connector housing in an initial state of assembly.

Referring in more detail to the drawings, FIGS. 1 (partially assembled) and 1A (fully assembled) illustrate a ferrule assembly 10 constructed in accordance with one aspect of the invention, wherein the ferrule assembly 10 includes at least a ferrule 12, constructed in accordance with another aspect of the invention, an electrically conductive textile sleeve 14, and an electrical connector 16. The textile sleeve 16 can be provided having any suitable length to provide protection to an elongate electrical member 18, whether a single electrical cable, bundled wire harness, or otherwise, extending therethrough and having any suitable diameter. Further, the textile sleeve 16 can be constructed having a circumferentially closes or open woven, knit or braided yarn structure, wherein the conductive aspect can be provided via electrically conductive yarns, coatings, films, foil, or otherwise. In addition, the conductive aspect of the electrical connector 16 can be provided via a separate conductive inner surface 20, or the connector can be constructed having a conductive metal housing. The ferrule 12 is configured to couple the electrically conductive textile sleeve 14 to the electrical connector 16, wherein the attachment of the sleeve 14 to the connector 16 is made external to the connector 16, thereby providing an easy mechanism for attachment and detachment, such as may be required during service of at least one of the aforementioned components. In addition, the connection established by the ferrule 12 ensures a watertight seal is established and maintained between the ferrule 12 and the connector 16, as well as between the ferrule 12 and the elongate electrical member 18.

The ferrule 12 has a cylindrical wall 22 with an inner surface 24 providing a cavity 26 sized for receipt of the elongate electrical member 18 therethrough. The cylindrical wall 22 extends between a first end 28 configured for attachment within a cavity 30 of the textile sleeve 14 and a second end 32 having a radially outwardly extending annular rim 34 configured for attachment to the electrical connector 16. The cylindrical wall 22 has at least one radially outwardly extending annular bead, and is shown here, by way of example and without limitation, as having a pair of annular beads 36, 38 adjacent the first end 28 with the annular beads 36, 38 providing radially inwardly facing annular concave pockets 40, 42. The beads 36, 38 are spaced axially from one another by a radially outwardly facing annular recess 39 such that the recess 39 forms a valley between the upstanding beads 36, 38. Respective seal members 44, 46 are disposed in the pockets 40, 42 for sealed abutment with the inner surface 24 and the elongate electrical member 18. The seal members 44, 46 are shown as being o-ring type seals, though any suitable seal configuration can be used, depending on the geometry of the beads 36, 38.

The rim 34 has an annular leg portion 48 that extends radially outward from the cylindrical wall 22, shown as extending perpendicular from or substantially perpendicular from the cylindrical wall 22, and a cylindrical outer lip portion 50 reverse folded in overlying relation to the cylindrical wall 22, such that the outer lip portion 50 is aligned radially outwardly from the cylindrical wall 22. As such, a generally c-shaped annular pocket 52 at the second end 32 is formed by the cylindrical wall 22, the leg portion 48 and the lip portion 50 in open facing relation to the first end 28. An outer surface 54 of the lip portion 50 is dimensioned for a close, line-to-line or slight interference fit within the electrical connector 16 such that an electrical connection is established between the ferrule 12 and the electrical connector 16.

To facilitate establishing and maintaining a fluid-tight seal between the ferrule 12 and the electrical connector 16, an elastomeric annular seal 56 is disposed between an outer surface of the cylindrical wall 22 and the inner surface 20 of the connector 16. The seal 56 is illustrated as being received partially with the pocket 52. The seal 56 has a radially outwardly extending sealing surface represented, by way of example and without limitation, as radially outwardly extending annular lips 58 configured for an interference fit against the connector 16 and a radially inwardly extending sealing surface represented, by way of example and without limitation, as radially inwardly extending lips 60 configured for an interference fit against the cylindrical wall 22.

Figure 1A:
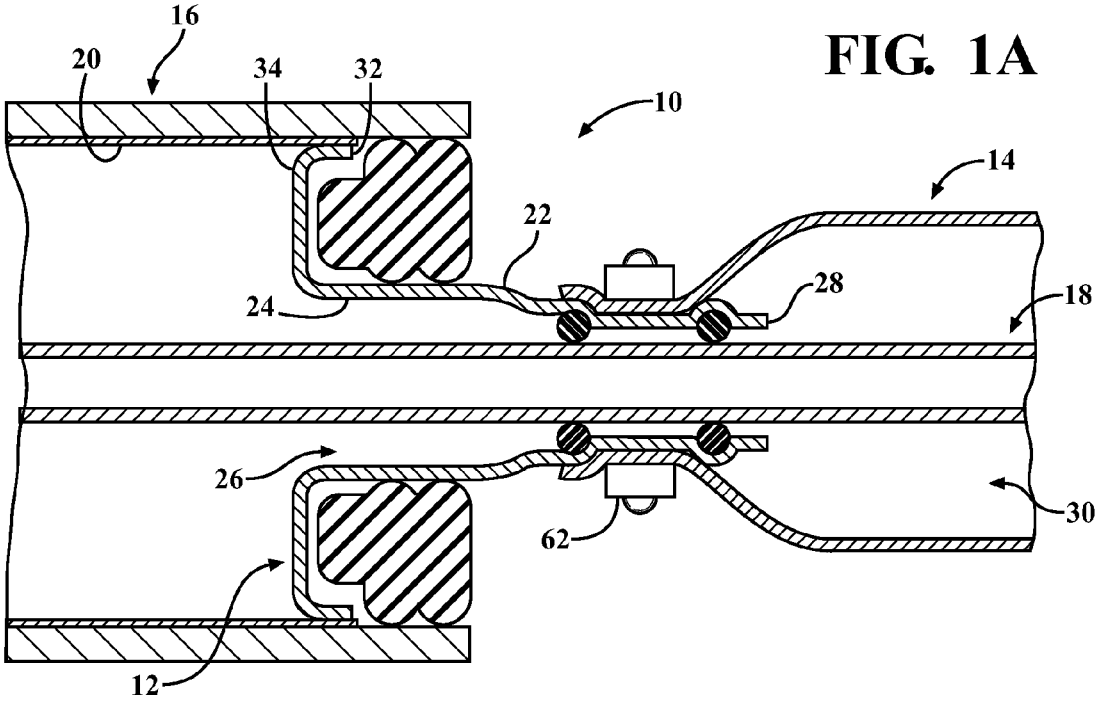
FIG. 1A illustrates the ferrule of FIG. 1 shown in a fully assembled state.

During assembly, the textile sleeve 14 is disposed over at least a portion the cylindrical wall 22 adjacent the first end 28, either before or after the ferrule 12 is assembled within the electrical connector 16, and then, to bring the ferrule 12 and seal members 44, 46 into their respective sealing abutment against the elongate electrical members 18, an adjustable clamp ring 62 is disposed over the textile sleeve 14 and brought into radial alignment with the recess 39 between the beads 36, 38. Then, the clamp ring 62 is tightened to constrict from its unclamped position, as shown in FIG. 1, to its reduced diameter, constricted position, shown in FIG. 1A. Accordingly, the reduction in diameter of the clamp ring 62 causes the sleeve 14 and the ferrule 12 to be compressed radially inwardly, thereby compressing the seals 44, 46 between their respective bead pockets 40, 42 and an outer surface of the elongate electrical member 18.

With the clamp ring 62 being received within the recess 39 between the beads 36, 38, the clamp ring 62 is assured of being maintained in its clamping position on the ferrule 12, wherein the clamp ring 62 is restricted against possible axial movement by the beads 36, 38. Further, with the clamp ring 62 being readily accessible axially outwardly from the electrical connector 16, the clamp ring 62 can be selectively removed easily during service without having to first remove the ferrule 12 from the connector 16.

In FIG. 2, a ferrule assembly 110 constructed in accordance with another aspect of the invention is illustrated, wherein the same reference numerals used above, offset by a factor of 100, identify similar features.

The ferrule assembly 110 includes at least a ferrule 112, constructed in accordance with another aspect of the invention, an electrically conductive textile sleeve 114, and an electrical connector 116. Further, as in the previous embodiment, the assembly 110 includes a seal 156 to establish a fluid-tight seal between a cylindrical wall 122 of the ferrule 112 and the connector 116. The cylindrical wall 122 extends between a first end 128 configured for attachment within a cavity 130 of the textile sleeve 114 and a second end 132 having a radially outwardly extending annular rim 134 configured for attachment to the electrical connector 116. The cylindrical wall 122 has a radially outwardly extending annular bead, shown as a half bead 136, extending to the first end 128 with the annular bead 136 providing a radially inwardly facing annular pocket 140 and a radially outwardly facing recess 139 between the half bead 136 and the rim 134. An elastomeric seal member 144 is disposed in the pocket 140 for sealed abutment with an inner surface 124 of the ferrule half bead 136 and an outer surface of an elongate electrical member 118. The seal member 144 is shown as being generally rectangular in cross-section, though any suitable seal configuration can be used, depending on the geometry of the bead 136 and the pocket 140. The annular rim 134 is configured the same as discussed above, and thus, is not discussed further. The primary difference between the embodiments 12, 112 being the difference in the respective bead constructions.

To bring the ferrule 112 and seal member 144 into their respective sealing abutment against the elongate electrical member 118, an adjustable clamp ring 162 is disposed over the textile sleeve 114 in radial alignment with the recess 139. Then, the clamp ring 162 is tightened to a constricted, reduced diameter configuration. Accordingly, the reduction in diameter of the clamp ring 162 causes the sleeve 114 and the first end 128 of the ferrule 112 to be compressed radially inwardly, thereby compressing the seal 144 between the inner surface of the bead pocket 140 and the outer surface of the elongate electrical member 118.

With the clamp ring 162 being received within the recess 139 between the bead 136 and the seal 156, the clamp ring 162 is assured of being maintained in its clamping position on the ferrule 112, wherein the clamp ring 162 is restrained against axial movement. Further, with the clamp ring 162 being readily accessible axially outwardly from the electrical connector 116, the clamp ring 62 can be removed easily during service without having to first remove the ferrule 12 from the connector 16, and thus, the sleeve 114 can be easily removed as desired.

In FIG. 3, a ferrule assembly 210 constructed in accordance with another aspect of the invention is illustrated, wherein the same reference numerals used above, offset by a factor of 200, identify similar features.

The ferrule assembly 210 has a ferrule 212 constructed the same as the ferrule 112 discussed above, and thus, is not discussed in further detail. The notable difference is in how a clamp ring 262 is position and fastened about the ferrule 212. To bring the ferrule 212 and seal member 244 into their respective, clamped sealing abutment against an elongate electrical member 218, the radially adjustable clamp ring 262 is disposed over the textile sleeve 214 in radial alignment with a half bead 236 of the ferrule 112 and the seal 244 is disposed within a radially inwardly facing pocket 240 formed by the half bead 236. Then, the clamp ring 262 is constricted radially inwardly to a reduced diameter position. Accordingly, the reduction in diameter of the clamp ring 262 causes the sleeve 214 and the ferrule 212 to be compressed radially inwardly, thereby compressing the seal 244 between the bead pocket 240 and the elongate electrical member 218.

Figure 4:
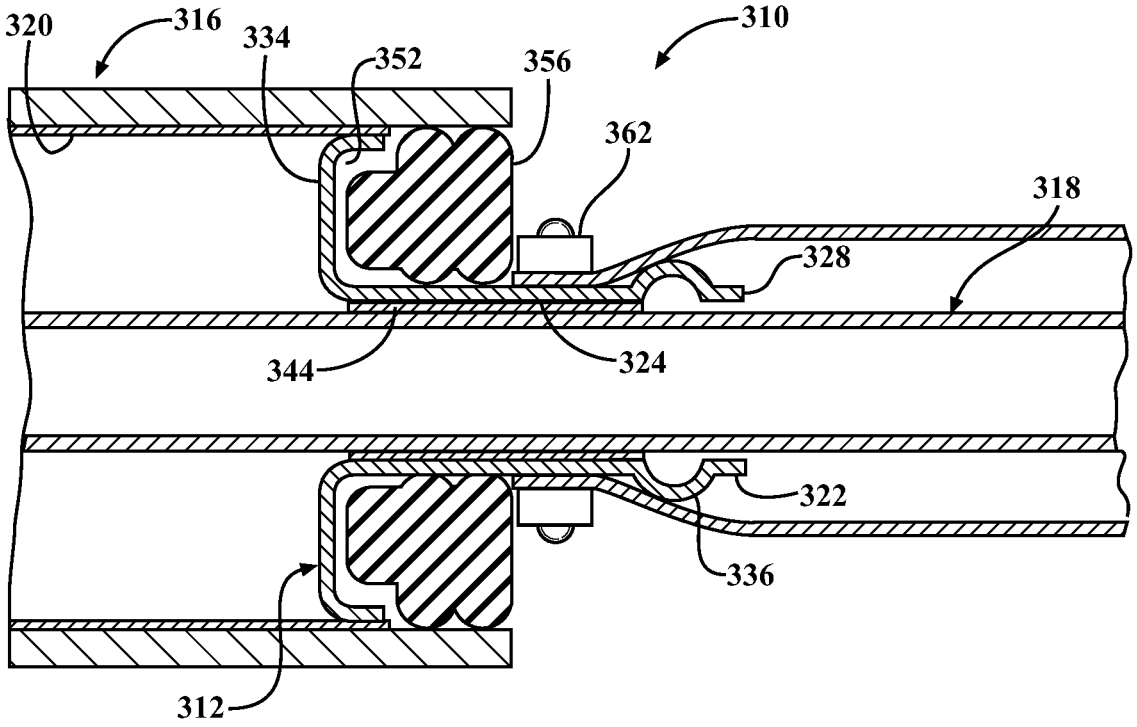
FIG. 4 illustrates a cross-sectional side view of a ferrule constructed in accordance with yet another aspect of the invention shown coupling a textile protective sleeve to an electrical connector housing.

In FIG. 4, a ferrule assembly 310 constructed in accordance with another aspect of the invention is illustrated, wherein the same reference numerals used above, offset by a factor of 300, identify similar features.

The ferrule assembly 310 has a ferrule 312 constructed similarly as described and illustrated for the ferrule 12, with the exception being that the ferrule 312 has a cylindrical wall 322 having a single annular bead 336 adjacent its first end 328. And so, unlike the embodiment of FIGS. 1 and 1A wherein a clamp ring is clamped between the pair of axially spaced beads, a clamp ring 362 is fastened about the cylindrical wall 322 adjacent the single bead 336, wherein the clamp ring 362 is disposed between the bead 336 and a rim 334 of the ferrule 312. The rim 334 is constructed the same as discussed above with regard to the rim 34, and thus, is not described in further detail.

To facilitate establishing and maintaining a fluid-tight seal between the ferrule 312 and an electrical connector 316, an elastomeric annular seal 356 is disposed between an outer surface of the cylindrical wall 322 and the inner surface 320 of the connector 316. The seal 356 is illustrated as being received partially with a pocket 352 of the rim 334, as discussed above. The seal 356 is generally flush with a second end of the connector 316, with the clamp ring 362 being disposed between the seal 356 and the bead 336, such that the bead 336 acts as a stop surface to prevent axial movement of the clamp ring 362 upon being fully assembled. As in the previous embodiments, the clamp ring 362 remains disposed axially outwardly from the connector 316 upon being clamped, thereby allowing easy access to the clamp ring 362 for servicing purposes. To further facilitate establishing a fluid-tight seal between the ferrule 312 and an elongate electrical member 318, an annular seal 344 is disposed between an inner surface 324 of the ferrule 312 and the elongate electrical member 318. The seal 344 is represented here as being fixed to the inner surface 324, such as by being bonded or otherwise adhered to the cylindrical inner surface 324 between the bead 336 and the rim 334. The seal 344 can be provided as a material coating, plated surface, etched surface, or co-injected material, for example. Thus, rather than requiring a separate, loose component to perfect a seal between the ferrule 310 and the elongate electrical member 318, the seal 344 is fixed to the inner surface 324 of the ferrule 312 as a single piece component therewith.

Obviously, many modifications and variations of the present invention are possible in light of the above teachings. It is, therefore, to be understood that within the scope of the appended claims, the invention may be practiced otherwise than as specifically described.

What is claimed is:

1. A ferrule configured to couple a textile sleeve to an electrical connector, comprising:

a cylindrical wall having an inner surface providing a cavity sized for receipt of an elongate electrical member therethrough, said cylindrical wall extending between a first end configured for attachment within a cavity of the textile sleeve and a second end having a radially outwardly extending annular rim configured for attachment to the electrical connector, said rim provides a generally C-shaped annular pocket adjacent said second end and further comprising an elastomeric seal disposed in said generally C-shaped annular pocket, said cylindrical wall having at least one radially outwardly extending annular bead adjacent said first end with said annular bead providing a radially inwardly facing annular pocket; and at least one seal member disposed in said cavity for sealed abutment with said inner surface and the elongate electrical member.

2. The ferrule of claim 1 wherein said at least one seal member is disposed in said pocket.

3. The ferrule of claim 1 wherein said at least one seal member extends between said pocket and said second end.

4. The ferrule of claim 3 wherein said at least one seal member is fixed to said inner surface of said cylindrical wall.

5. The ferrule of claim 4 wherein said at least one seal member is bonded to said inner surface of said cylindrical wall.

6. The ferrule of claim 1 wherein said cylindrical wall has at least two radially outwardly extending annular beads spaced axially from one another by an annular recess with each of said beads providing a radially inwardly facing annular pocket.

7. The ferrule of claim 6 wherein said at least one seal member includes a plurality of seal members with a separate one of said seal members disposed in each of said pockets.

8. The ferrule of claim 1 wherein said at least one radially outwardly extending annular bead is a half bead.

9. The ferrule of claim 1 wherein said at least one radially outwardly extending annular bead is a full bead forming said radially inwardly facing annular pocket having a concave contour.

10. A ferrule in combination with an electrically conductive textile sleeve, an elongate electrical member received in said textile sleeve, and an electrically conductive electrical connector, said ferrule comprising:

a cylindrical wall having an inner surface providing a cavity sized for receipt of said elongate electrical member therethrough, said cylindrical wall extending between a first end configured for attachment within a cavity of said textile sleeve and a second end having a radially outwardly extending annular rim configured for attachment to said electrical connector, said rim provides a generally C-shaped annular pocket adjacent said second end and further comprising an elastomeric seal disposed in said generally C-shaped annular pocket, said cylindrical wall having at least one radially outwardly extending annular bead adjacent said first end with said annular bead providing a radially inwardly facing annular pocket; and at least one seal member disposed in said cavity for sealed abutment with said inner surface and said elongate electrical member.

11. The combination of claim 10 wherein said at least one seal member is disposed in said pocket.

12. The combination of claim 10 wherein said at least one seal member extends between said pocket and said second end.

13. The combination of claim 12 wherein said at least one seal member is fixed to said inner surface of said cylindrical wall.

14. The combination of claim 13 wherein said at least one seal member is bonded to said inner surface of said cylindrical wall.

15. The combination of claim 10 wherein said cylindrical wall has at least two radially outwardly extending annular beads spaced axially from one another by an annular recess with each of said beads providing a radially inwardly facing annular pocket.

16. The combination of claim 15 wherein said at least one seal member includes a plurality of seal members with a separate one of said seal members disposed in each of said pockets.

17. The combination of claim 10 wherein said at least one radially outwardly extending annular bead is a half bead.

18. The combination of claim 10 wherein said at least one radially outwardly extending annular bead is a full bead forming said radially inwardly facing annular pocket having a concave contour.

* * * * *